United States Patent [19]

Tong

[11] Patent Number: 4,614,920

[45] Date of Patent: Sep. 30, 1986

[54] WAVEGUIDE MANIFOLD COUPLED MULTIPLEXER WITH TRIPLE MODE FILTERS

[75] Inventor: Robert S. K. Tong, Kitchener, Canada

[73] Assignee: Com Dev Ltd., Cambridge, Canada

[21] Appl. No.: 690,741

[22] Filed: Jan. 11, 1985

[30] Foreign Application Priority Data

May 28, 1984 [CA] Canada ..... 4552849

[51] Int. Cl.[4] ..... H01P 5/12; H01P 1/208

[52] U.S. Cl. ..... 333/135; 333/212

[58] Field of Search ..... 333/212, 209, 208, 137, 333/135, 134, 132, 129, 126, 122, 121; 370/123, 72, 69.1, 112, 37

[56] References Cited

U.S. PATENT DOCUMENTS

| | | | |
|---|---|---|---|
| 2,686,902 | 8/1954 | Tillotson | 333/212 X |
| 4,129,840 | 12/1978 | Mok | 333/208 |
| 4,135,133 | 1/1979 | Mok | 333/212 X |
| 4,200,847 | 4/1980 | Nishikawa et al. | 333/126 X |
| 4,410,865 | 10/1983 | Young et al. | 333/209 X |

FOREIGN PATENT DOCUMENTS

| | | | |
|---|---|---|---|
| 2431278 | 1/1975 | Fed. Rep. of Germany | 333/212 |
| 0097348 | 8/1979 | Japan | 333/135 |

OTHER PUBLICATIONS

Edson et al; "Input Manifold for Microwave Channelizing Filters"; *IEEE Transaction on Microwave Theory & Technique;* vol. M77-18, No. 5, 5/1970; pp. 270-276.

*Primary Examiner*—Eugene R. LaRoche
*Assistant Examiner*—Benny T. Lee
*Attorney, Agent, or Firm*—Daryl W. Schnurr

[57] ABSTRACT

A multiplexer has a plurality of bandpass filters coupled through E-plane or H-plane T-junctions to a waveguide manifold. Where the multiplexer has four channels and each filter is a six-pole filter, two triple mode cavities make up each filter. Where each filter is a five-pole filter, one triple cavity and one dual mode cavity makes up each filter. Two band edge channel filters are operated to produce an asymmetrical filter function response, thereby causing extra transmission zeros to be created and improving the selectivity of the filter out of the passband. The multiplexer is designed for use in satellite communication systems and can have a reduced volume and weight when compared to previous multiplexers without any sacrifice in electrical performance.

12 Claims, 6 Drawing Figures

PRIOR ART

WAVEGUIDE MANIFOLD COUPLED MULTIPLEXER WITH TRIPLE MODE FILTERS

BACKGROUND OF THE INVENTION

1. Field of the Invention

This invention relates to multiplexers and, in particular, to contiguous band multiplexers having at least one filter with a cavity resonating in a triple mode for use in satellite communication systems.

2. Description of the Prior Art

Contiguous frequency band multiplexers are known but, in previous multiplexers, dual mode or single mode filters are used. The volume and weight of previous multiplexers is significantly greater than the volume or weight required with the multiplexer in accordance with the present invention in order to produce similar results. Also, the multiplexer of the present invention is able to produce improved passband performance and band edge selectivity over previous multiplexers.

Poor selectivity on a band edge channel filter of previous contiguous band multiplexers has been a long-standing problem in the communications satellite industry.

SUMMARY OF THE INVENTION

A multiplexer has a plurality of bandpass filters, each filter having an input and output with said output being coupled through a T-junction to a waveguide manifold. At least one filter is a triple mode filter and has at least one cavity that can resonate in a triple mode when said triple mode filter is operated in suitable propagation modes to produce an elliptic function response, said cavity having two end walls that are parallel to one another.

Preferably, each filter of the multiplexer is a triple mode filter and has a cavity, with two end walls that are parallel to one another, that can resonate in a triple mode so that each triple mode filter can produce an elliptic function response.

Still more preferably, each filter is a triple mode filter having two or more cavities with one of said cavities resonating in a triple mode.

DESCRIPTION OF THE DRAWINGS

In the following drawings, there are shown embodiments of the present invention:

FIG. 5(*b*) is a graph showing the frequency response of a multiplexer constructed in accordance with that shown in FIG. 1.

DESCRIPTION OF A PREFERRED EMBODIMENT

Figure 1:
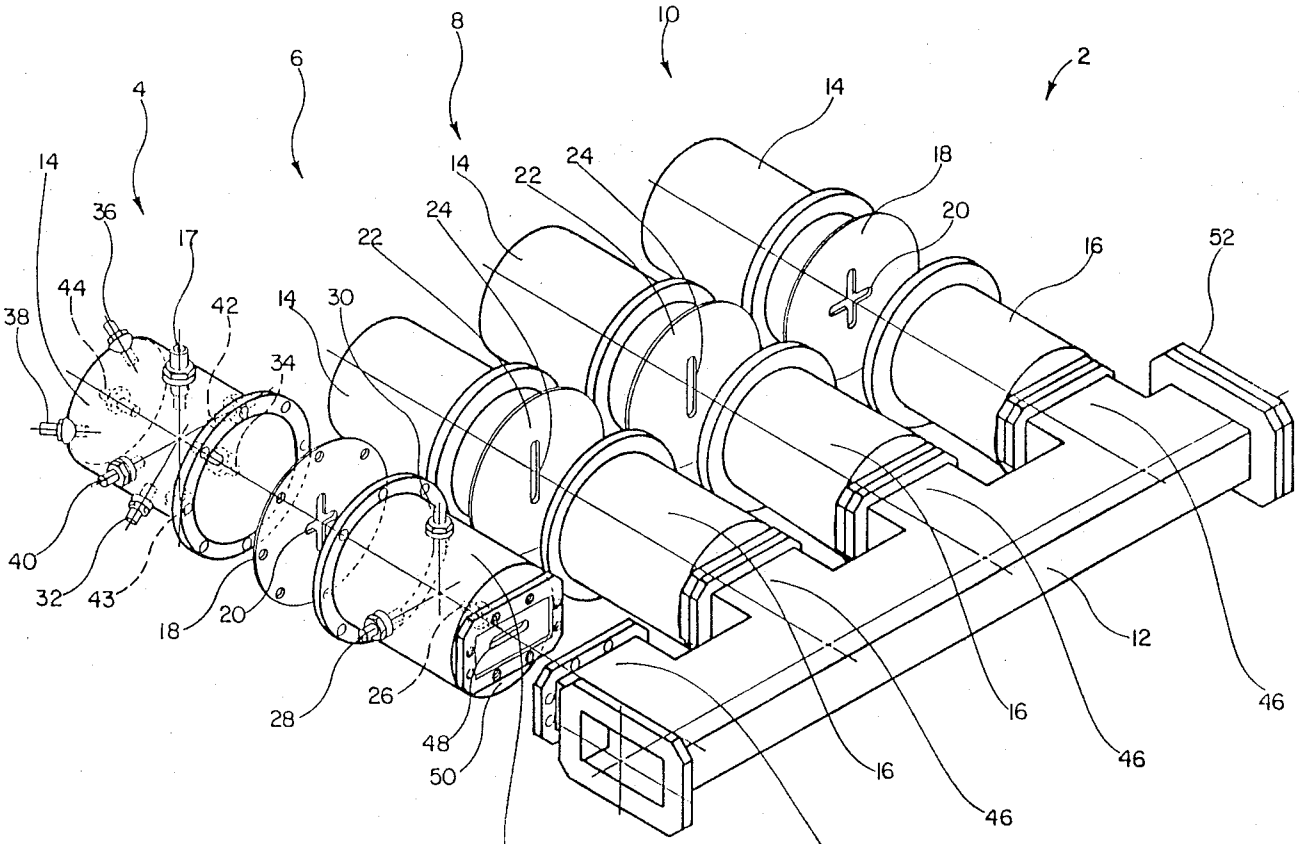
FIG. 1 is a partially exploded perspective view of a four channel contiguous band multiplexer having one cavity in each filter operating in triple mode and the remaining cavity of each filter operating in dual mode.

Referring to the drawings in greater detail, in FIG. 1 there is shown a multiplexer 2 having four channels or bandpass filters 4, 6, 8, 10, electrically connected in cascade, coupled to a waveguide manifold 12. Each filter 4, 6, 8, 10 has two cavities 14, 16. Each cavity 14 resonates in triple mode and each cavity 16 resonates in dual mode. Preferably, each cavity 14 resonates in first $TE_{111}$, second $TM_{010}$ and third $TE_{111}$ mode while each cavity 16 resonates in first and second $TE_{111}$ mode.

An iris 18 having an aperture 20 is located between the cavities 14, 16 of the filters 4, 10. An iris 22 having an aperture 24 is located between the cavities 14, 16 of the filters 6, 8. The irises 18, 22 provide inter-cavity coupling means between the cavities 14, 16 of the particular filters in which they are installed. Then cavity 14 has an input coupling through coaxial probe 17.

Inter-cavity coupling is achieved by means of a physical discontinuity which perturbs the electrical field of one mode to couple energy into another mode. The cavity 16 have coupling screw 26 and tuning screws 28, 30. The cavities 14 having coupling screws 32, 34 provide coupling between the two orthogonal $TE_{111}$ modes. Coupling between the $TE_{111}$ mode and the $TE_{010}$ mode in cavities 14 is provided by coupling screw 36, 38. Tuning screws 40, 42, 43 provide frequency tuning of the $TE_{111}$ orthogonal mode. Tuning screw 44 provides frequency tuning of the $TM_{010}$ mode. The same arrangement of tuning screws and coupling screws as that shown for cavities 14, 16 of filter 4 is the same for the cavities 14, 16 of the three remaining filters 6, 8, 10 but is not shown on these remaining filters.

Filters 4, 10, being the band edge channels, are five-pole quasi-elliptic function filters with three transmission zeros. Filters 6, 8 are five-pole quasi-elliptic function filters with one pair of transmission zeros. Filters 4, 10 are the first and last filters respectively in the multiplexer 2.

As stated above, inter-cavity coupling between the dual mode cavity 16 and the triple mode cavity 14 of each filter is provided through the apertures shown. Coupling aperture 20 of iris 18 provided the necessary coupling for the third transmission zero for each of the band edge channels, being filters 4, 10. All four filters 4, 6, 8, 10 are coupled to H-plane, T-junctions 46 of the waveguide manifold 12 through output couplings provided by aperture 48 located in an end 50 of each cavity 16. The aperture 48 is only shown for the filter 4 but exists in the remaining filters 6, 8, 10 as well. The T-junctions 46 are connected in cascade to form the manifold 12. One end of the manifold 12 is terminated by short circuit plate 52.

While the filters shown in FIG. 1 are of fifth order filter function, filters can be designed of any order realized in a cascade of triple mode cavities alone or triple mode cavities along with dual mode cavities or single mode cavities. For example, in a four channel multiplexer, each filter can have two cavities where each cavity resonates in a triple mode so that each filter is of the sixth order. Also, other forms of asymmetrical filter functions can be used for the improvement of band edge channel selectivity.

Figure 2:
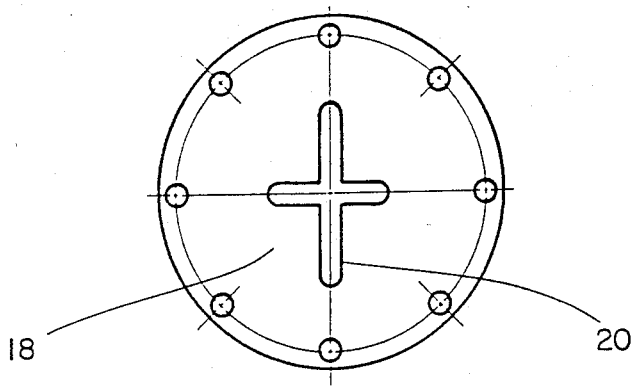
FIG. 2 is a front view of an iris used in the multiplexer.
Figure 3:
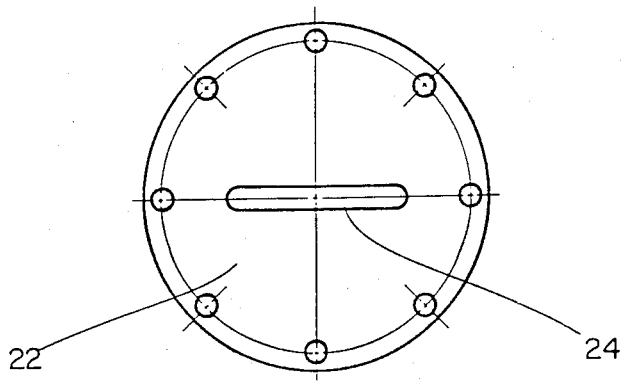
FIG. 3 is a front view of another type of iris used in the multiplexer.

In FIG. 2, an iris 18 has an aperture 20. The aperture is cruciform in shape and is used in filters 4, 10 as these are the band edge filters and produce an asymmetrical electrical response. In FIG. 3, there is shown an iris 22 having an aperture 24 which is a single slot. Filters 6, 8, require the use of coupling iris 22 in order to produce a symmetrical electrical response.

Figure 4:
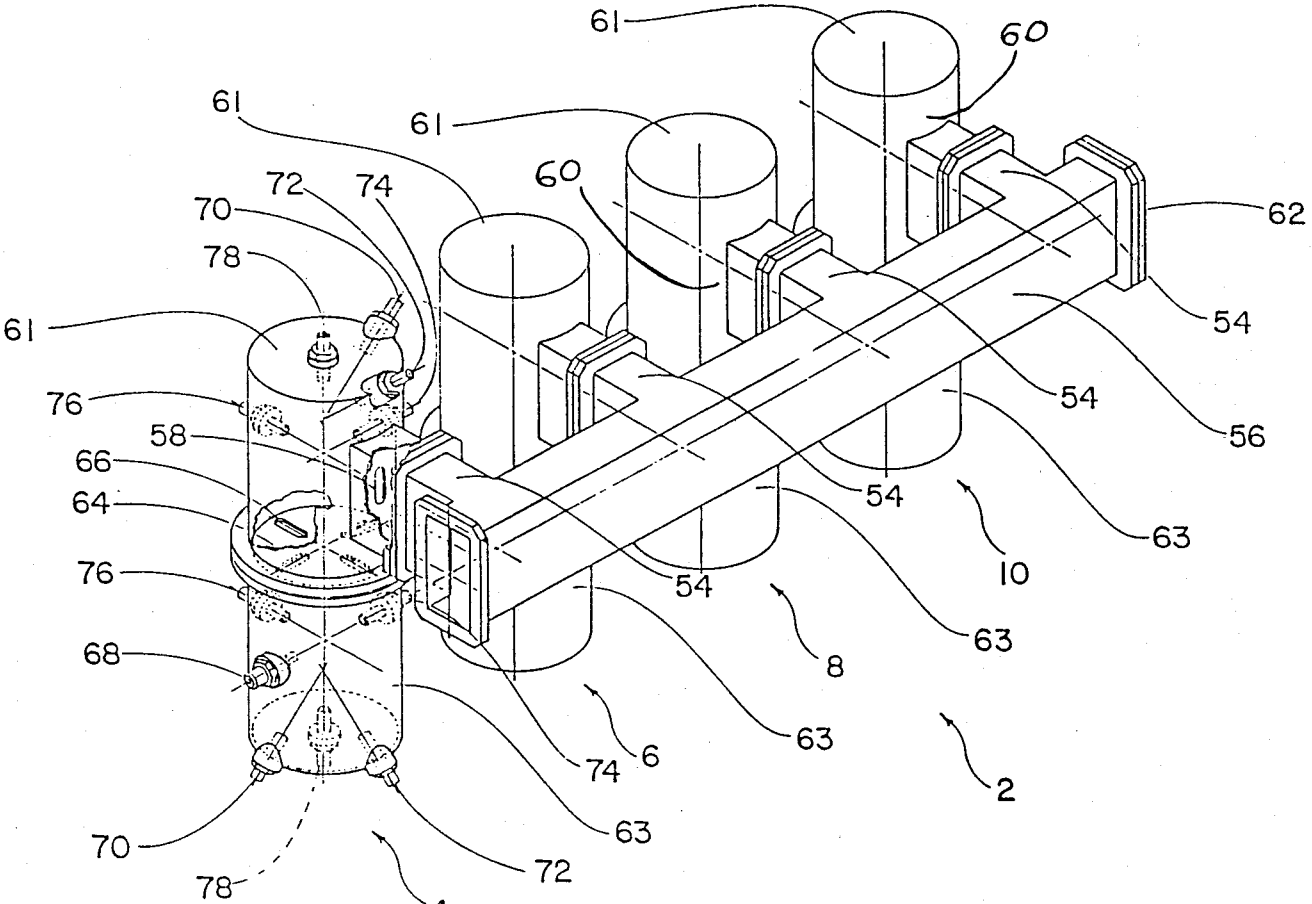
FIG. 4 is a partial perspective view of a four channel multiplexer where all filters are coupled to E-plane, T-junctions of a manifold.

In FIG. 4, a multiplexer 2 has filters 4, 6, 8, 10 coupled to E-plane, T-junctions 54 of waveguide manifold 56. All four filters 4, 6, 8, 10 are coupled to E-plane, T-junction 54 of the manifold 56 through output coupling provided by aperture 58 located in a side 60 of each cavity 61. The manifold 56 is terminated at one end by a short circuit plate 62.

Each of the filters 4, 6, 8, 10 has two cavities, 61, 63, each cavity resonating in a triple mode. Preferably, each cavity 61, 63 resonates in a first, $TE_{111}$, a second $TM_{010}$ and a third $TE_{111}$ mode. An iris 64 having an aperture 66 is represented by four radially separate and equidistant slots. The iris 64 provides inter-cavity coupling means between the cavities 61, 63 and is located in each of the filters 4, 6, 8, 10, even though it is only shown in the filter 4. Cavity 63 of the filter 4 has an input coupling through coaxial probes 68.

The cavities 61, 63 of each filter 4, 6, 8, 10 having coupling screws 70, 72 to provide coupling between the two orthogonal $TE_{111}$ and $TM_{010}$ modes. Tuning screws 74, 76 provide frequency tuning of the first $TE_{111}$ and the third $TE_{111}$ modes. Tuning screw 78 provides frequency tuning of the $TM_{010}$ mode. The same arrangement of tuning screws and coupling screws as that shown for cavities 61, 63 of filter 4 is used for the cavity 61, 63 of the three remaining filters 6, 8, 10 but is not shown on these remaining filters.

Filters 4, 6, 8, 10 are six-pole elliptic function filters with two pairs of transmission zeros. Each filter 4, 6, 8, 10 is referred to as a channel and coupling aperture 66 of iris 64 provides the necessary coupling for the two pairs of transmission zeros for each channel.

The aperture 58 is only shown for the filter 4 but exists in the remaining filters 6, 8, 10 as well. The T-junctions 54 are connected in cascade to form the manifold 56.

Figure 5A:
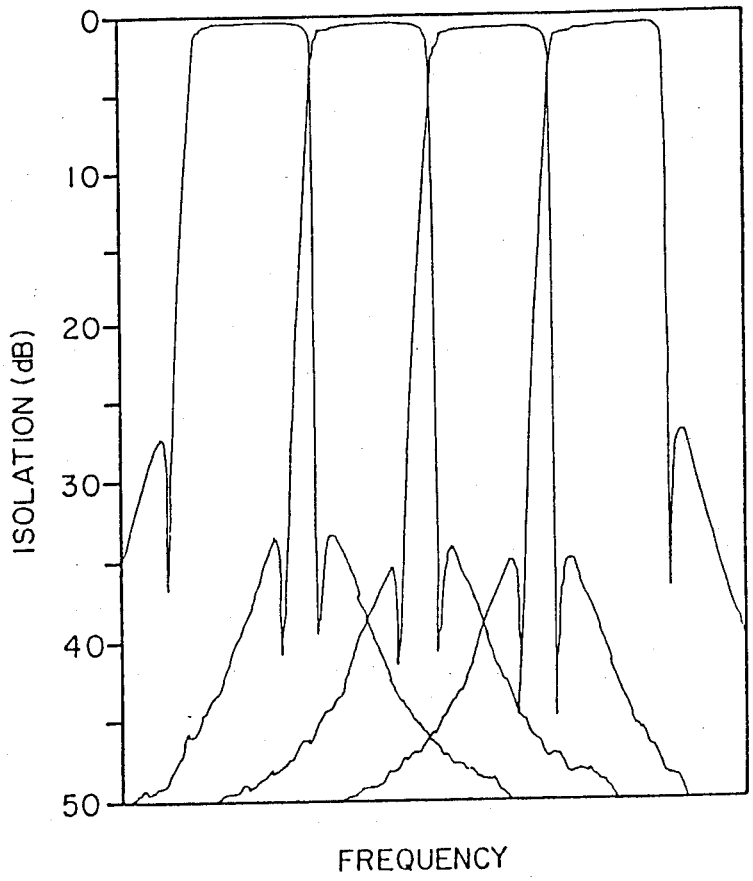
FIG. 5(*a*) is a graph showing the frequency response of a prior art four channel contiguous band multiplexer having sixth order dual mode quasi-elliptic function filters.
Figure 5B:
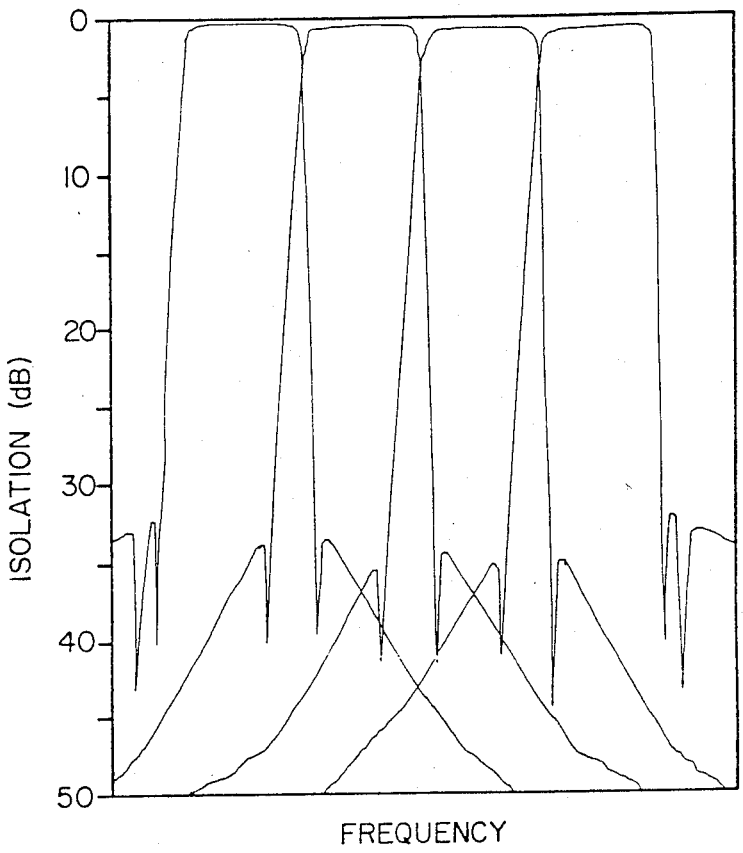

In FIG. 5(*a*), there is shown an amplitude response for a prior art four channel multiplexer where each filter has three dual mode cavities coupled to a waveguide manifold. In FIG. 5(*b*), there is shown an amplitude response of a four channel multiplexer constructed in accordance with FIG. 1 where each filter has two cavities, one cavity operating in triple mode and the remaining cavity operating in dual mode. It can readily be seen from comparing FIGS. 5(*a*) and 5(*b*) that out-of-band selectivity is improved when a multiplexer is designed in accordance with the present invention. The passband portions of FIGS. 5(*a*) and 5(*b*) are essentially the same. Therefore, the multiplexer of the present invention can achieve a significant weight and volume saving over previously known multiplexers with little or no sacrifice in electrical performance in the passband. In addition, by using asymmetrical response filters for band edge channels in accordance with the present invention, an improved band edge selectivity can be achieved over previously known multiplexers.

While the multiplexer 2 shown in FIG. 1 has four filters 4, 6, 8, 10 with each filter having one triple mode and one dual mode resonator cavity, it will be readily apparent to those skilled in the art that it will be possible to design a multiplexer, within the scope of the attached claims, having any reasonable number of filters. Further, it will be possible, within the scope of the attached claims, for the filters to have any reasonable number of triple mode cavities. Some or all of the filters could have only triple mode cavities or the triple mode cavities of any particular filter or filters could be used together with one or more dual mode or one or more single mode cavities. Where five-pole filters are desired, the preferred arrangement is one dual mode cavity and one triple mode cavity. Where six-pole filters are desired, two triple mode cavities are the preferred arrangement.

What I claim as my invention is:

1. A multiplexer comprising a plurality of bandpass filters, each filter having an input and output, with said output being coupled through a T-junction to a waveguide manifold, at least one filter being a triple mode filter and having at least one cavity that resonates in a triple mode when said triple mode filter is operated in suitable propagation modes to produce an elliptic function response, said cavity having two end walls that are parallel to one another.

2. A multiplexer as claimed in claim 1 wherein each filter is a triple mode filter and has at least one cavity, with two end walls that are parallel to one another, that resonates in a triple mode so that each triple mode filter can produce an elliptic function response.

3. A multiplexer as claimed in any one of claims 1 or 2 wherein at least one of the filters is an odd order bandpass filter with the output being located in a cavity that resonates in a dual mode.

4. A multiplexer as claimed in any one of claims 1 or 2 wherein there is at least one bandpass filter of the order N, where N is an integer multiple of three and the output of said filter is located in a cavity that resonates in a triple mode and has two ends that are parallel to one another.

5. A multiplexer as claimed in any one of claims 1 or 2 wherein the output of at least one filter is located in a cavity that has two ends that are parallel to one another, said cavity resonating in a dual mode and being coupled to an H-plane T-junction through an iris located at said output.

6. A multiplexer as claimed in any one of claims 1 or 2 wherein the output of at least one filter is located in a side of the cavity that resonates in a triple mode and is coupled to an E-plane T-junction in a triple mode through an iris located at said output in a side of said triple mode cavity.

7. A multiplexer as claimed in claim 2 wherein each filter has two cavities, the triple mode cavity and a cavity that resonates in a dual mode with the output being located in the dual mode cavity.

8. A multipler as claimed in claim 2 wherein each filter has two cavities resonating in a triple mode.

9. A multiplexer as claimed in any one of claims 7 or 8 wherein there are four filters.

10. A multiplexer as claimed in claim 2 wherein band edge channel filters are operated to realize an asymmetrical filter function response, said band edge channel filters being the first and last filters respectively in the multiplexer.

11. A multiplexer as claimed in any one of claims 1, 2 or 8 wherein each triple mode cavity resonates in a $TE_{111}$, second $TM_{010}$ and third $TE_{111}$ mode.

12. A multiplexer as claimed in claim 7 wherein the triple mode cavity resonates in a first $TE_{111}$, second $TM_{010}$ and third $TE_{111}$ mode and the dual mode cavity resonates in a first and second $TE_{111}$ mode.

* * * * *